United States Patent [19]

Urquhart et al.

[11] Patent Number: 4,600,491

[45] Date of Patent: Jul. 15, 1986

[54] WORKPIECE DRYING APPARATUS

[76] Inventors: Thomas N. Urquhart, 3051 Kingsley Dr., Troy, Mich. 48084; Gordon T. Urquhart, 19171 Filmore, Southfield, Mich. 48075

[21] Appl. No.: 611,176

[22] Filed: May 17, 1984

[51] Int. Cl.[4] ..... C25D 13/00; F26B 3/28

[52] U.S. Cl. ..... 204/300 EC; 118/642; 34/39; 34/68; 34/4; 34/243 C; 34/236

[58] Field of Search ..... 204/299 EC, 300 EC, 204/226, 227; 34/4, 39, 68, 243 C, 189, 190, 236, 202; 118/64, 641, 642, 643

[56] References Cited

U.S. PATENT DOCUMENTS

| | | | |
|---|---|---|---|
| 3,575,832 | 4/1971 | Johnson | 204/300 EC |
| 4,136,463 | 1/1979 | Nolan et al. | 34/39 |
| 4,268,973 | 5/1981 | Jezuit et al. | 34/185 |
| 4,314,410 | 2/1982 | Nichols | 34/202 |
| 4,319,408 | 3/1982 | Kuboyama | 34/39 |
| 4,416,068 | 11/1983 | Nilsson et al. | 34/68 |
| 4,480,394 | 11/1984 | Salas | 34/202 |
| 4,546,553 | 10/1985 | Best | 34/39 |

FOREIGN PATENT DOCUMENTS

| | | |
|---|---|---|
| 906582 | 8/1972 | Canada . |
| 956045 | 9/1982 | U.S.S.R. . |

*Primary Examiner*—Howard S. Williams
*Assistant Examiner*—B. J. Boggs, Jr.
*Attorney, Agent, or Firm*—Markell Seitzman

[57] ABSTRACT

A container comprising a bottom and walls extending therefrom forming a volume having an opening opposite from said bottom; and means for enclosing the volume, the enclosing means including means for supporting and suspending a workpiece within the enclosed volume apart from the walls and the bottom and means for circulating the heated air within said enclosed volume including an axial or radial flow fan.

16 Claims, 1 Drawing Figure

WORKPIECE DRYING APPARATUS

BACKGROUND AND SUMMARY OF THE INVENTION

This invention relates to electrodeposition and coating systems for workpieces in general and, more particularly, to a workpiece carrier for a work carrier unit.

In electrodeposition systems the workpiece to be coated is moved through a series of work stations wherein the body may be immersed or subjected to high pressure spray for the purpsoes of prerinsing the workpiece prior to being immersed in a phosphating or electropainting solution wherein a protective coating is applied to the body. Thereafter, the workpiece is moved to a heating or baking oven for drying and curing the finish or protective coating. One such electrodeposition system is disclosed in our Patent Application Ser. No. 551,564 entitled "Electrodeposition Systems and Method Therefor." This application illustrates an electrodeposition system which minimizes the dragout of fluid from one work station to another and permits a uniform protective and sufficiently heavy coating of painted material to be applied to the under and over surfaces of the workpiece. In this system the workpiece is progressively moved through a plurality of work processing stations arranged in a predetermined sequence. The stations may include spray and immersion tanks, postrinse tanks, an electropainting tank and baking oven cells.

The present invention is an improvement to the invention disclosed in the above-identified patent application.

It is an object of the present invention to further minimize the dragout of fluid from one work processing station to another.

A further object of the present invention is to provide means for increasing the air flow over the workpiece after it is removed from the various spray and immersion tanks or while it is in a heating cell to rapidly cure the electropainted protective coating placed thereon, to improve the reaction time during which it takes the coating to cure and to generally shorten the overall processing times.

Accordingly the invention comprises a container comprising a bottom and walls extending therefrom forming a volume having an opening opposite from said bottom; and means for enclosing the volume, the enclosing means including means for supporting and suspending a workpiece within the enclosed volume apart from the walls and the bottom and means for circulating the heated air within said enclosed volume including an axial or radial flow fan.

Many other objects and purposes of the invention will be clear from the following detailed description of the drawings.

DETAILED DESCRIPTION OF THE DRAWINGS

Figure 1:
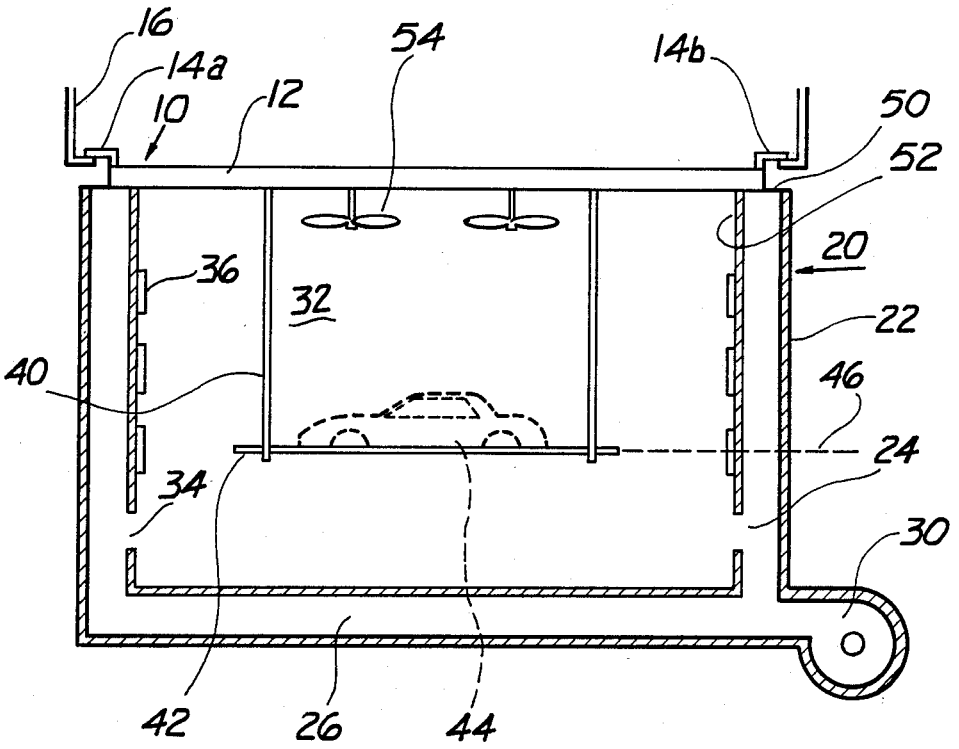

Reference is made to FIG. 1 which illustrates a work carrier unit 10. The work carrier unit 10 comprises a lid 12 having outwardly extending members 14*a* and *b*. These outwardly extending members 14*a* and *b* are adapted to engage a crane 16 which is only partially shown. The crane 16 is illustrated in greater detail in the above-identified patent application which is herein expressly incorporated by reference. The crane, in concert with the members 14, permits the work carrier unit

10 to be raised and lowered into work processing stations generally designated as 20. It should be appreciated the work processing station or container 20 illustrated in FIG. 1 is but one of many such stations into which the work carrier unit may be lowered. More specifically, the work processing station 20 illustrated is a heating oven comprising a container or cell 22 having walls 24 and a bottom 26. The walls 24 of the cell 22 may be hollow to permit the flow of heated air from a heating unit or furnace 30 to provide heated air into the volume 32 within the walls 24 and bottom 26. The flow of the heated air from the furnace 30 into the volume 32 may be by means of heat ducts or openings 34 within the walls and/or bottom 26. Alternatively, the interior of the walls 24 and/or bottom 26 may include radiant material 36 which is heated by the hot air within the walls 24 to a temperature which will permit these radiant units 36 to radiate heat into the volume 32 thus avoiding the need to provide the ducts and openings 34. It should be understood, however, that the radiant units 36 and the ducts and openings 34 may be used in combination. One such heating cell is described in greater detail in the above-identified patent application. The walls 24 further provide a means 50 for supporting the work carrier unit 10.

The work carrier unit 10 further includes a superstructure 40 for supporting a platform 42 onto which a workpiece 44 may be placed. The platform 42 is rotationally movable about axis 46 such that the workpiece 44 may be oscillated or rotated thereabout. A means for rotating the platform 42 relative to the superstructure 40 must be provided. One such means is also illustrated in U.S. Ser. No. 551,564. It should be appreciated that such a rotating means may include sprocket gears or a rack and pinion gear moved by a motor which may be supported by the lid 12 having appropriate power distribution means for powering such a motor when the work carrier unit is seated upon the container 20 or, alternatively, when the work carrier unit is suspended apart from the container 20 by the crane 16. Such power distribution means are also illustrated in the above-identified patent application.

It is preferable that the lid 12 of the work carrier unit 10 seat upon the ends 50 of each of the walls proximate the open end 52 of the container in a manner to substantially enclose the volume 32. The work carrier unit 10 further includes means for circulating air within the volume 32 and for directing the air flow over and against the workpiece. Such means are generally designated as 54 and may comprise at least one electrical fan, such as an axial or radial flow or other fan, mounted to the underside of the lid 40.

In operation within the context of a work processing station such as the heating cell 22 illustrated in FIG. 1, the fans 54 direct heated air residing within the volume 32 over and across the various surfaces of the workpiece thus shortening the drying time needed for curing the protective coating previously placed upon the workpiece. In the context of use within the heating cell 22 the fans 54 would be activated after the work carrier unit has been seated upon the walls 24 of the heating cell 22. The fans 54 may further remain active after the workpiece 44 has been removed from the cell 22.

The fans 54 provide further improvements to electropainting systems in general apart from directing the flow of heated air across a workpiece within the context of the heating cell 22. As previously mentioned, another work processing station 20 may comprise a spray booth wherein a rinsing agent is sprayed under pressure against the workpiece. To improve and shorten the overall process time, it is desirable to rapidly dry the workpiece. Heretofore after removal from a rinse work processing station, the workpiece was dried by the ambient air. A further advantage of the present invention is that after the work carrier unit 10 and workpiece 44 have been removed from these rinse stations, the fans are powered thus directing air across the surfaces of the workpiece thereby shortening drying time. To further improve the drying of the workpiece 44, it is contemplated, within the context of the present invention, to rotate the platform 42 relative to the fans 54 thus exposing a greater surface area of the workpiece to the air flow and hence further shortening the process time.

A further advantage of the present invention can be seen from the following. As described in the aforementioned patent application, after the workpiece has been immersed into an electropainting solution and a protective coating has been applied to the workpiece, the crane 16 lifts the work carrier unit 10 and workpiece 44 from the electropainting solution. The platform 44 is then oscillated with the workpiece positioned above the solution to permit excess solution trapped within the cavities of the workpiece to drain therefrom thus reducing dragout of fluid from the electrodeposition work processing station. Activating the fans 54 while the workpiece 44 is positioned above the solution and rotating it relative to the onrushing air flow shortens the drainage time and increases the drainage thus minimizing the dragout of fluid and further initiates the curing action of the electrodeposited coating.

Many changes and modifications in the above-described embodiment of the invention can, of course, be carried out without departing from the scope thereof. Accordingly, that scope is intended to be limited only by the scope of the appended claims.

What is claimed is:

1. An apparatus comprising:

a container comprising a bottom and walls extending therefrom forming a volume into which a workpiece to be dried is received, including an opening opposite from said bottom; and means for enclosing said volume and operative to prevent communication therethrough, the enclosing means including means for supporting and for suspending a workpiece within said volume apart from said walls and said bottom and circulating means, supported by said enclosing means, for circulating heated air within said volume.

2. The apparatus as defined in claim 1 wherein said enclosing means includes means for engaging the end of the walls proximate said opening and for seating thereon and for forming in cooperation with said container an enclosed volume.

3. The apparatus as defined in claim 2 wherein said walls are hollow and wherein said apparatus further includes blower means for urging heated air through said hollow walls, for heating the walls to a level sufficient for said walls to radiate heat onto said workpiece.

4. The apparatus as defined in claim 3 further including means for activating said blower means after said enclosing means has seated upon said container.

5. The apparatus as defined in claim 4 wherein the outer portions of said walls and bottom of said container are insulated.

6. The apparatus as defined in claim 5 wherein said means for supporting and suspending a workpiece further includes means for rotating the workpiece relative to the heated air.

7. The apparatus as defined in claim 1 wherein said circulating means is supported by and movable with said enclosing means and includes means for directing air flow against the workpiece.

8. The apparatus as defined in claim 7 wherein said means for supporting and suspending a workpiece further includes means for rotating the workpiece relative to said air flow.

9. The apparatus as defined in claim 8 further including means for activating said circulating means while said enclosing means is positioned upon said container as well as when said enclosing means is positioned above said container.

10. The apparatus as defined in claim 9 wherein said container includes means for wetting said workpiece.

11. The apparatus as defined in claim 10 wherein said means for wetting includes fluid into which said workpiece is lowered and rotated.

12. The apparatus as defined in claim 11 wherein said circulating means is activated after said workpiece has been removed from said fluid.

13. The apparatus as defined in claim 10 wherein said means for wetting includes means for spraying fluid on said workpiece.

14. The apparatus as defined in claim 7 wherein said circulating means includes at least one fan carried by said supporting means.

15. The apparatus as defined in claim 14 wherein said fan is an axial or radial flow fan.

16. The apparatus as defined in claim 1 further including means for raising and lowering said enclosing means relative to said container.

* * * * *